US006879226B2

(12) United States Patent
Vigneron et al.

(10) Patent No.: US 6,879,226 B2
(45) Date of Patent: Apr. 12, 2005

(54) WAVEGUIDE QUARDRUPLE MODE MICROWAVE FILTER HAVING ZERO TRANSMISSION

(75) Inventors: Serge Vigneron, Auterive (FR); Yannick Latouche, Leguevin (FR); Pierre Jarry, Talence (FR); Eric Kerherve, Talence (FR); Jean-Marie Pham, Merignac (FR); Nicolas Boutheiller, Meudon (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 10/495,072

(22) PCT Filed: Nov. 21, 2002

(86) PCT No.: PCT/FR02/03988

§ 371 (c)(1),
(2), (4) Date: May 7, 2004

(87) PCT Pub. No.: WO03/047022

PCT Pub. Date: Jun. 5, 2003

(65) Prior Publication Data

US 2004/0246078 A1 Dec. 9, 2004

(30) Foreign Application Priority Data

Nov. 26, 2001 (FR) ..... 01 15252

(51) Int. Cl.[7] ..... H01P 1/208
(52) U.S. Cl. ..... 333/208; 333/212
(58) Field of Search ..... 333/208, 209, 333/212, 230

(56) References Cited

U.S. PATENT DOCUMENTS 4,792,771 A 12/1988 Siu
5,821,837 A * 10/1998 Accatino et al. ..... 333/208
6,211,752 B1 4/2001 Gendraud et al.
6,538,535 B1 * 3/2003 Guglielmi et al. ..... 333/208

FOREIGN PATENT DOCUMENTS

FR 2 675 952 A 10/1992

OTHER PUBLICATIONS

R. Bonetti et al, "A Hexa–Mode Bandpass Filter", 1990 IEEE International Microwave Symposium—Digest, May 8–10, 1990, pp. 207–210, XP010004643.

G. Lastoria et al, "Cad of Triple–Mode Cavities in Rectangular Waveguide", IEEE Microwave and Guided Wave Letters, IEEE Inc., NY, US, vol. 8, No. 10, Oct. 1, 1998, pp. 339–341, XP000788271.

N. Boutheiller et al, "A Two Zero Fourth Order Microwave Waveguide Filter Using a Simple Rectangular Quadruple–Mode Cavity", 2002 IEEE MTT–S International Microwave Symposium Digest. (IMS 2002), Seattle, WA, Jun. 2–7, 200, IEEE, vol. 3 of 3, Jun. 2, 2002, pp. 1777–1780, XP001113948.

* cited by examiner

*Primary Examiner*—Seungsook Ham
(74) *Attorney, Agent, or Firm*—Sughrue Mion, PLLC

(57) ABSTRACT

The invention relates to a quadruple mode microwave filter having coupled cavities with a plurality of transmission zeros, said filter comprising at least one rectangular parallelepiped-shaped quadruple mode cavity, at least two rectangular irises, and two input/output waveguides. Tuning and coupling of the filter are obtained exclusively by the dimensions and mutual disposition of the at least one resonant cavity and the irises, without any screw or other tuning mechanism. All the faces of the cavities and the irises are either parallel or perpendicular to each other. In a preferred embodiment the irises are offcentered along the two transverse axes. According to one advantageous feature, the input mode and the output mode are the same, preferably the TE 10 fundamental mode.

8 Claims, 9 Drawing Sheets

Measured S21

Comparative

WAVEGUIDE QUARDRUPLE MODE MICROWAVE FILTER HAVING ZERO TRANSMISSION

The invention relates to a microwave multimode filter comprising at least one resonant cavity, input-output means and microwave energy coupling means for exciting resonance modes inside the resonant cavity. A filter of this kind is particularly useful at the output of a power amplifier stage, for example in radio transmitters. Some applications require a filter with a relatively large pass-band, high selectivity and low losses in the required band.

A conventional multimode filter also comprises means for coupling energy between modes, such means usually being adjustable to vary the transfer of energy between said modes. Adjustable means for tuning the frequency of the resonant cavity are also conventionally provided. The tuning and coupling functions are often provided by screws, pistons or other variable adjustment or tuning mechanisms.

A problem with these conventional means is precisely this adjustment, which is often difficult and highly labor intensive for the manufacturer, and therefore costly.

FIG. 1 shows a prior art filter of the above kind. This waveguide filter 19 has no transmission zeros. Consequently, it is necessary to generate a large number of poles to obtain the required selectivity, i.e. the rejection of frequencies outside the transmission band of the filter. The problem is that the large number of poles considerably increases insertion losses. The FIG. 1 filter is part of a length of waveguide 19 with an input flange 9 and an output flange 11. A large number of cylindrical bars or rods 13 are disposed perpendicularly to the longer side of the guide. Given their number, adjustment during manufacture is irksome.

A second prior art filter is described in the paper "Four-Pole Dual Mode Elliptic Filter Realized in Circular Cavity Without Screws", Luciano Accatino et al., IEEE Trans. MTT, V. 44, no. 12, pp 2680–2686, December 1996. This filter consists of a length of circular waveguide 20 disposed between an input waveguide 10 and an output waveguide 12. The input and output waveguides are coupled to the circular guide by plane transitions 24 and 26 with respective rectangular apertures 28 and 30. In the middle of the guide is an iris 22 with a rectangular aperture 29 whose axes are parallel to the axes of the rectangular apertures 28 and 30 of the plane transitions 24 and 26. A feature of this filter is that coupling between the modes and tuning of the filter are obtained by means of rectangular irises 25 of thickness E, which therefore behave as sections of rectangular guide. The axes of these rectangular guide sections or irises are oriented at a non-zero angle to the axes of the rectangular input guide 10 and the rectangular output guide 12 in a plane perpendicular to the propagation axis Z in the filter; these rotation angles of the irises about the axis Z provide the required tuning and coupling between the modes of the filter. There are no screws and no provision for external adjustment of the filter. However, manufacture is difficult because the irises must be positioned with great accuracy at arbitrary angles determined by electromagnetic simulation programs. Mass production would therefore seem likely to give rise to major problems.

FIG. 3 shows another dual mode circular waveguide filter that is described in U.S. Pat. No. 5,886,594 (M. Guglielmi et al.), whose description of the prior art is explicitly incorporated into the present application. In the above patent, as in the preceding example, the dual mode filter comprises a length of circular waveguide 20 disposed between an input waveguide 10 and an output waveguide 12. The input and output waveguides are coupled to the circular guide by plane transitions 24 and 26 with respective rectangular apertures 28 and 30.

The above document is cited because it teaches another microwave filter with no coupling or tuning adjustment screw. The coupling between the two orthogonal modes is obtained by the iris 22, which has an elliptical aperture 29 whose major axis is inclined at 45° to the axes x–x' of the aperture 28 and the axis y–y' of the aperture 30 in the plane transitions 24 and 26. As in the preceding example, this angle is critical, but is easier to obtain accurately. On the other hand, the coupling of the modes is highly dependent on the exact shape of the ellipse 29 and the thickness E of the iris, and the ellipse considerably complicates the simulation and computer-aided design calculations. Furthermore, the 45° inclination of the major axis of the ellipse to the main axes of the rectangular input aperture 28 and the rectangular output aperture 30 causes rotation of the polarization between the input and the output, an effect which is undesirable in the majority of practical implementations.

An object of the present invention is to provide a quadruple mode microwave filter with a plurality of transmission zeros that is lighter, less bulky, highly selective, and subject to lower insertion losses than prior art multimode filters.

Another object of the invention is to provide a filter having characteristics that lend themselves to simplified industrial manufacture whilst retaining optimized operating characteristics. To this end, the resonator of the invention is easier to assemble and requires no adjustment.

The above objects, together with other advantages that will become apparent hereinafter, are achieved by a quadruple mode microwave filter having a plurality of transmission zeros, said filter comprising at least one rectangular parallelepiped-shaped quadruple mode resonant cavity 16, an input waveguide 10 and an output waveguide 12, said cavity or cavities (16, 19, . . . ) being coupled to the input and output guides (and between them if there are several of them) by rectangular parallelepiped-shaped irises (15, 17, 18, . . . ), characterized in that all the faces of the cavities (16, 19, . . . ) and the irises (15, 17, 18, . . . ) are either parallel or perpendicular to each other.

In one particular embodiment, said input and output waveguides are rectangular and all the faces of the cavities (16, 19, . . . ), the irises (15, 17, 18, . . . ) and the input and output guides 10, 12 are either parallel or perpendicular to each other.

According to one feature, the resonance frequencies of the modes of electromagnetic propagation are determined by the dimensions of said at least one resonant cavity 16, and distribution of electromagnetic energy between the various modes is dependent only on the dimensions and the disposition of said irises.

In a preferred embodiment the dimensions of said input and output guides 10, 12 are chosen to attenuate all electromagnetic modes except for the TE 10 fundamental mode. According to an advantageous feature, the dimensions of said input and output guides 10, 12 are identical. According to another advantageous feature, the input mode and the output mode are the same.

In a preferred embodiment the irises 15, 17 are offcentered along the two transverse axes (X, Y) of said filter.

In a particularly advantageous embodiment, coupling between the various resonant modes of said at least one resonant cavity 16 and with the input and output modes is obtained exclusively by means of the irises 15, 17, to the exclusion of any screw or other tuning or adjustment mechanism.

Other features and advantages of the invention will become apparent in the light of the following detailed description of a few embodiments, which is given with reference to the appended drawings, in which:

FIG. 1, already referred to, is a perspective view of a prior art rectangular waveguide filter with numerous transverse rods;

Figure 7:
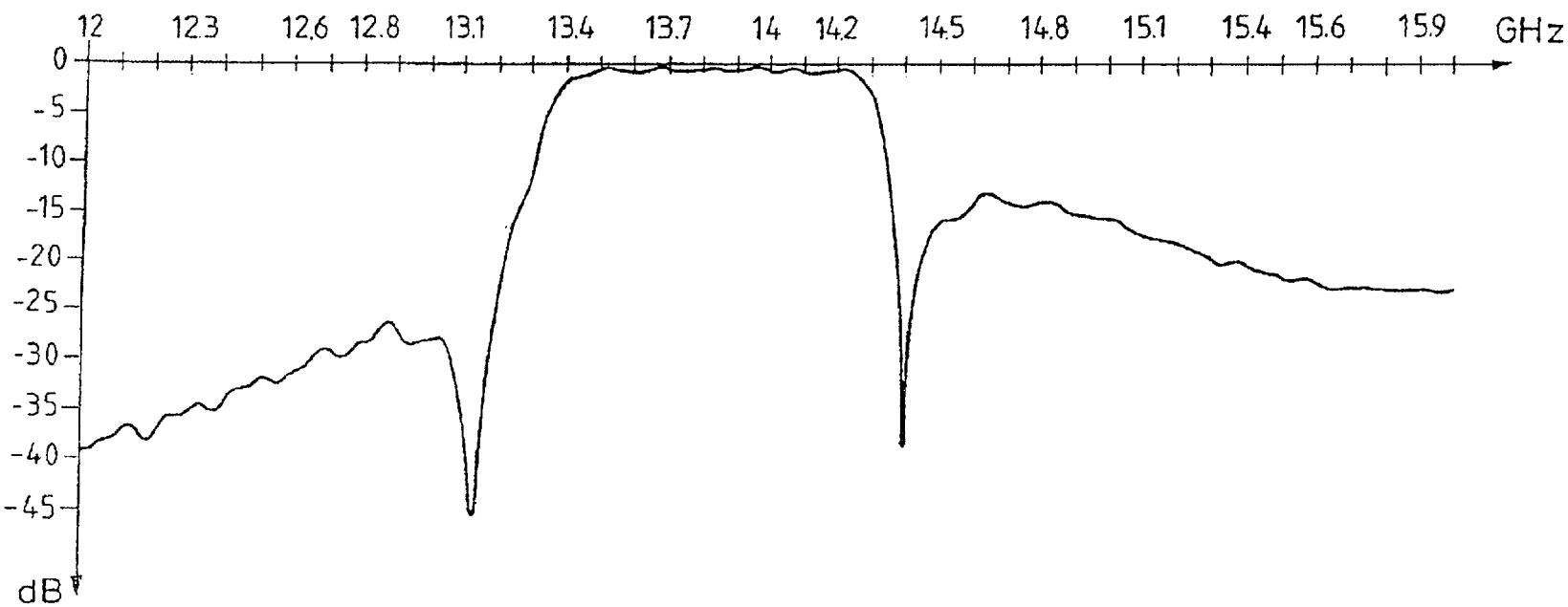
FIG. 7 shows transmission measurements obtained from a prototype of a filter according to the invention.
Figure 8:
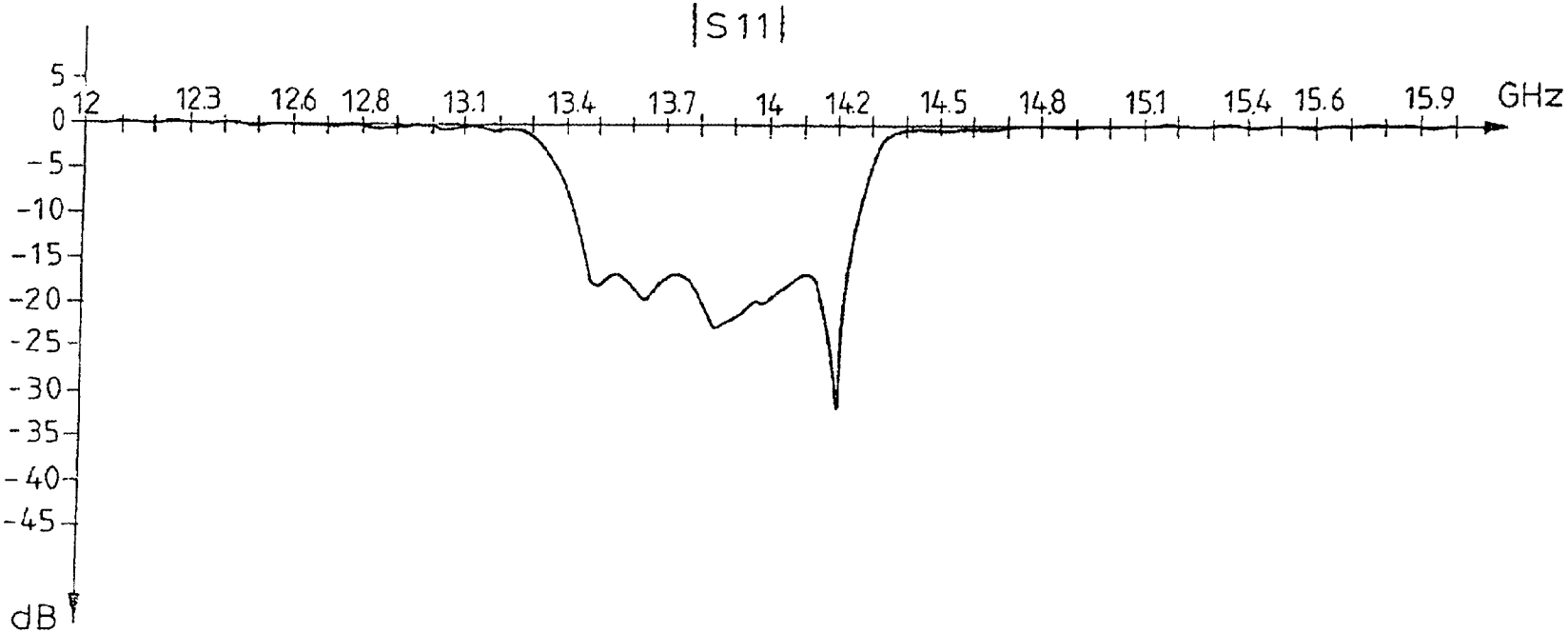
FIG. 8 shows input reflection measurements obtained from a prototype of a filter according to the invention.
Figure 9:
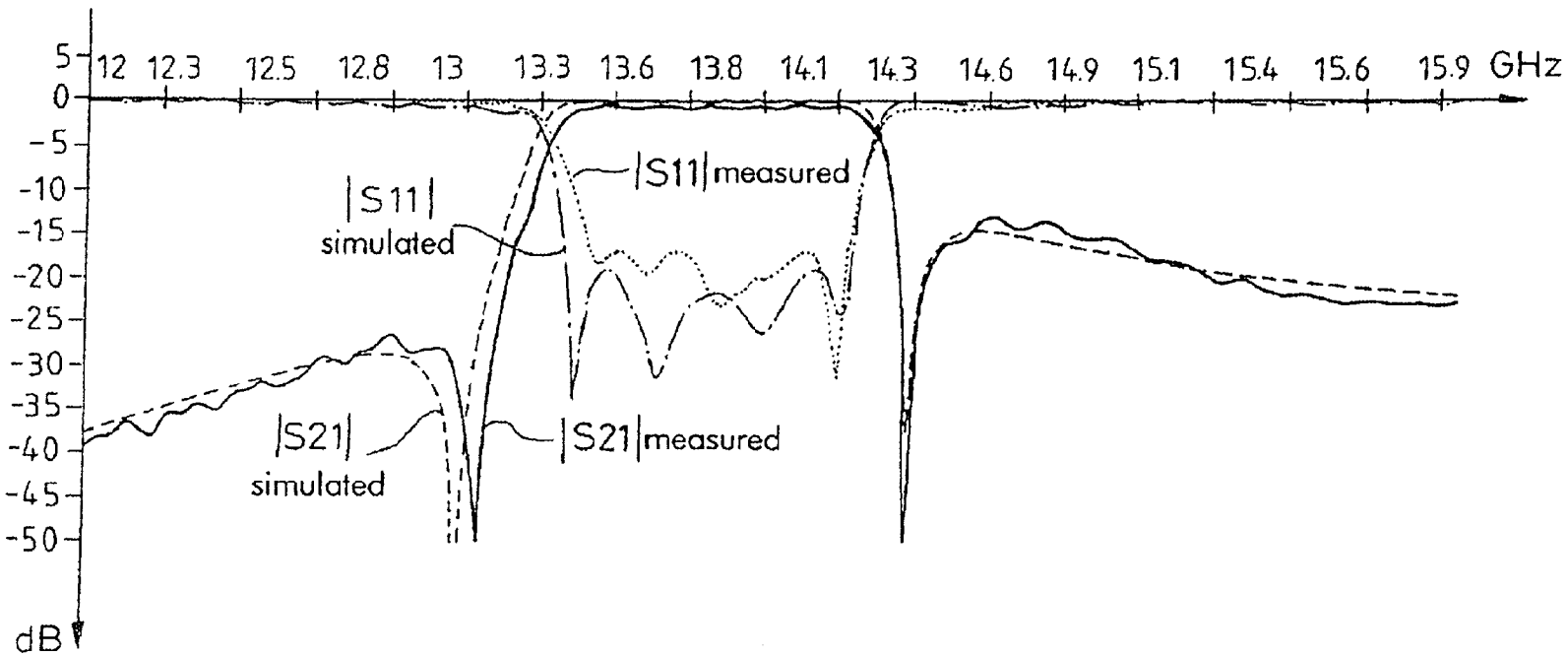
Figure 10:
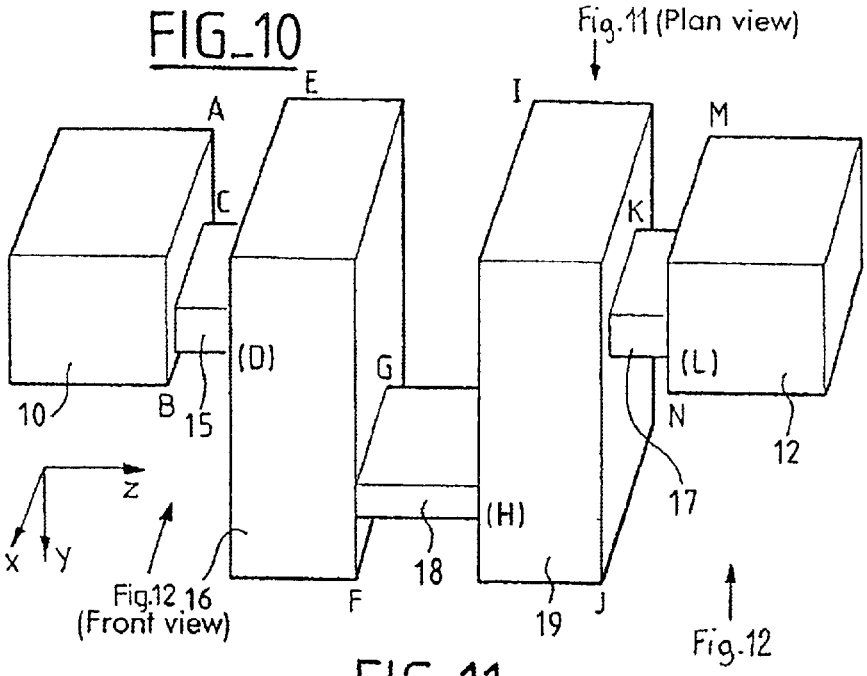
Figure 11:
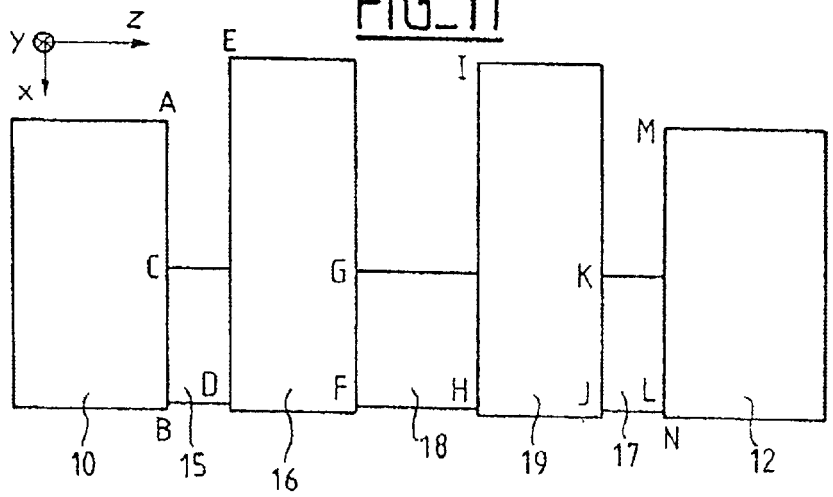
Figure 12:
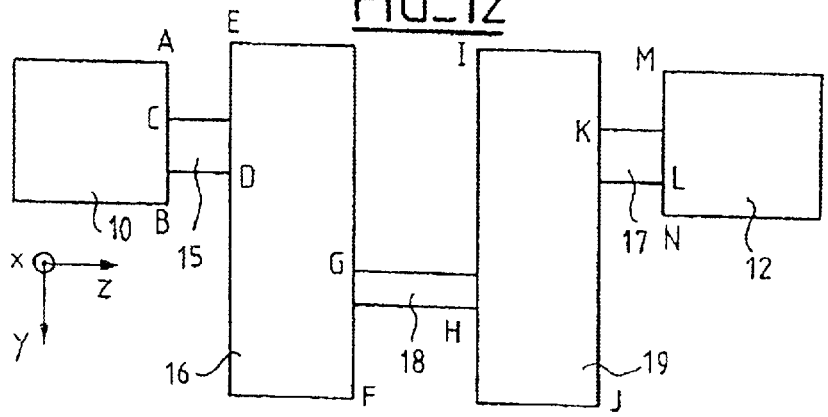
Figure 13:
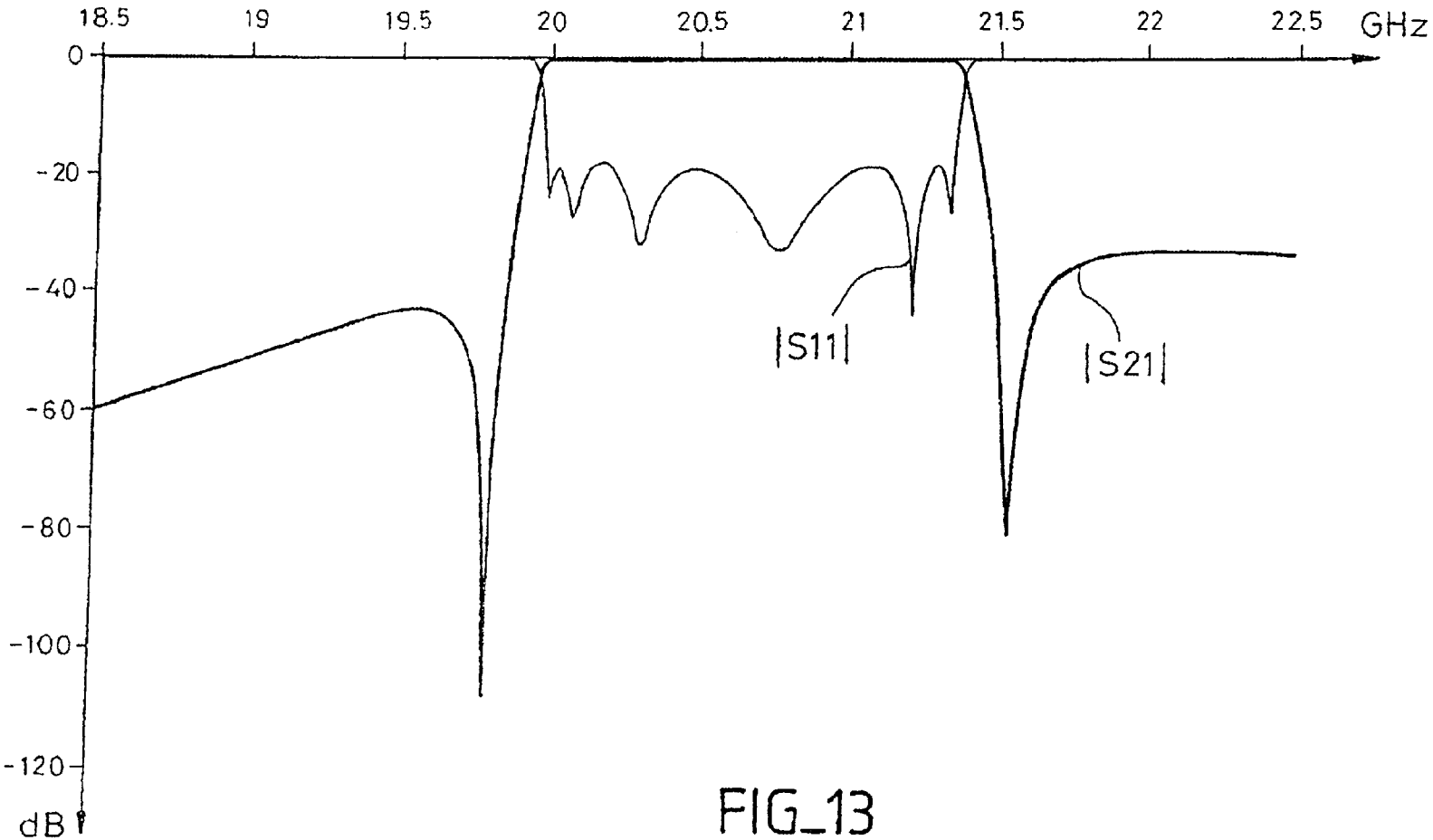

FIG. 9 compares two curves of measurements from FIGS. 7 and 8 with theoretical curves obtained by computer simulation based on electromagnetic equations;

FIG. 10 is a diagrammatic perspective view of one embodiment of a multiple cavity filter comprising at least one quadruple mode microwave cavity according to the invention;

FIG. 11 is a diagrammatic plan view of the FIG. 10 embodiment of the filter according to the invention;

FIG. 12 is a diagrammatic front view of the FIG. 10 embodiment of the filter according to the invention; and FIG. 13 shows simulations of reflection and transmission coefficients of a multiple cavity filter according to the invention as shown in FIGS. 10, 11 and 12.

The same reference numbers refer to the some items in all of the figures, which are provided by way of nonlimiting example and show a few examples of the prior art, examples of the invention, and examples of dimensions and of the performance that may be achieved. The scale is not always consistent, for reasons of clarity.

Figure 1:
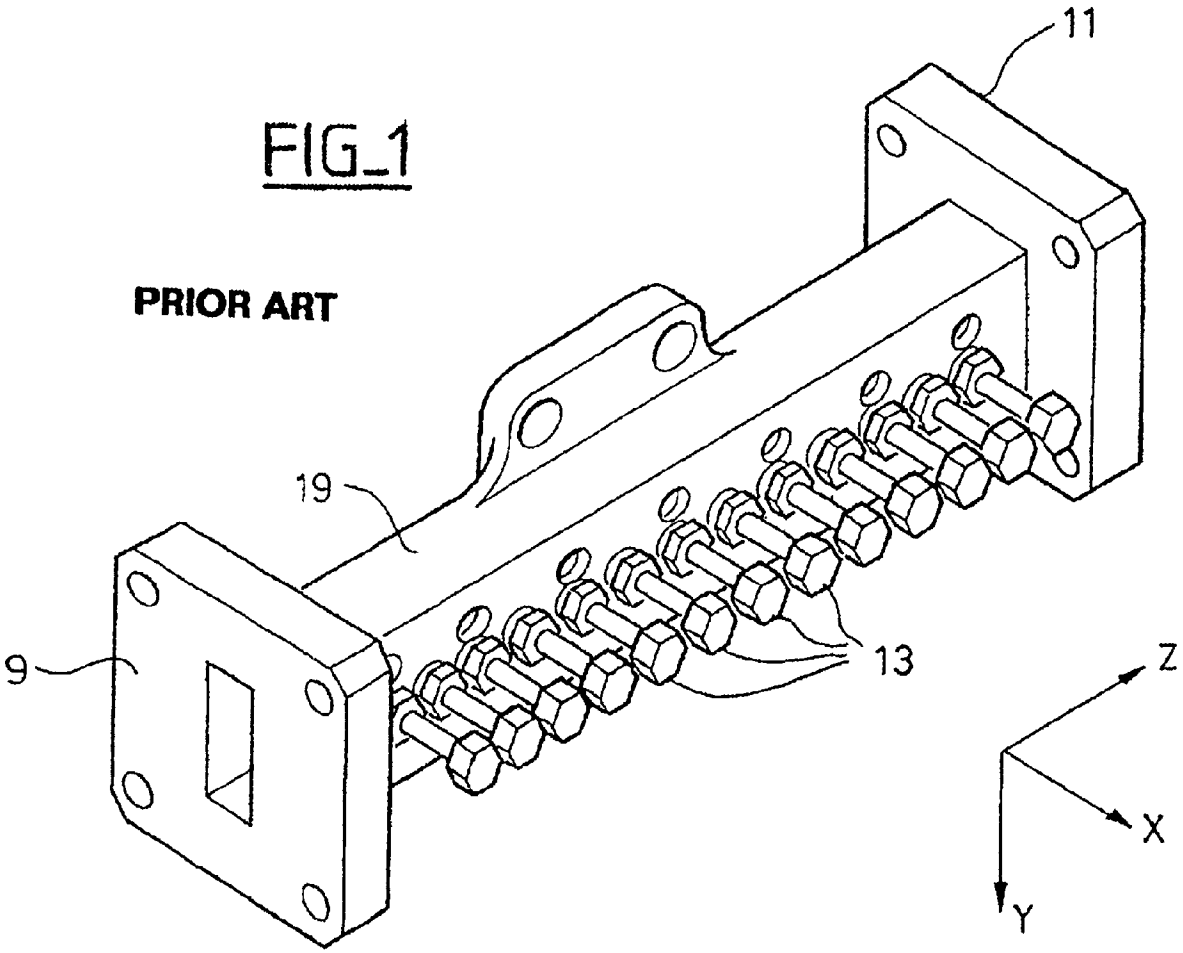
FIG 1 PRIOR ART
Figure 2:
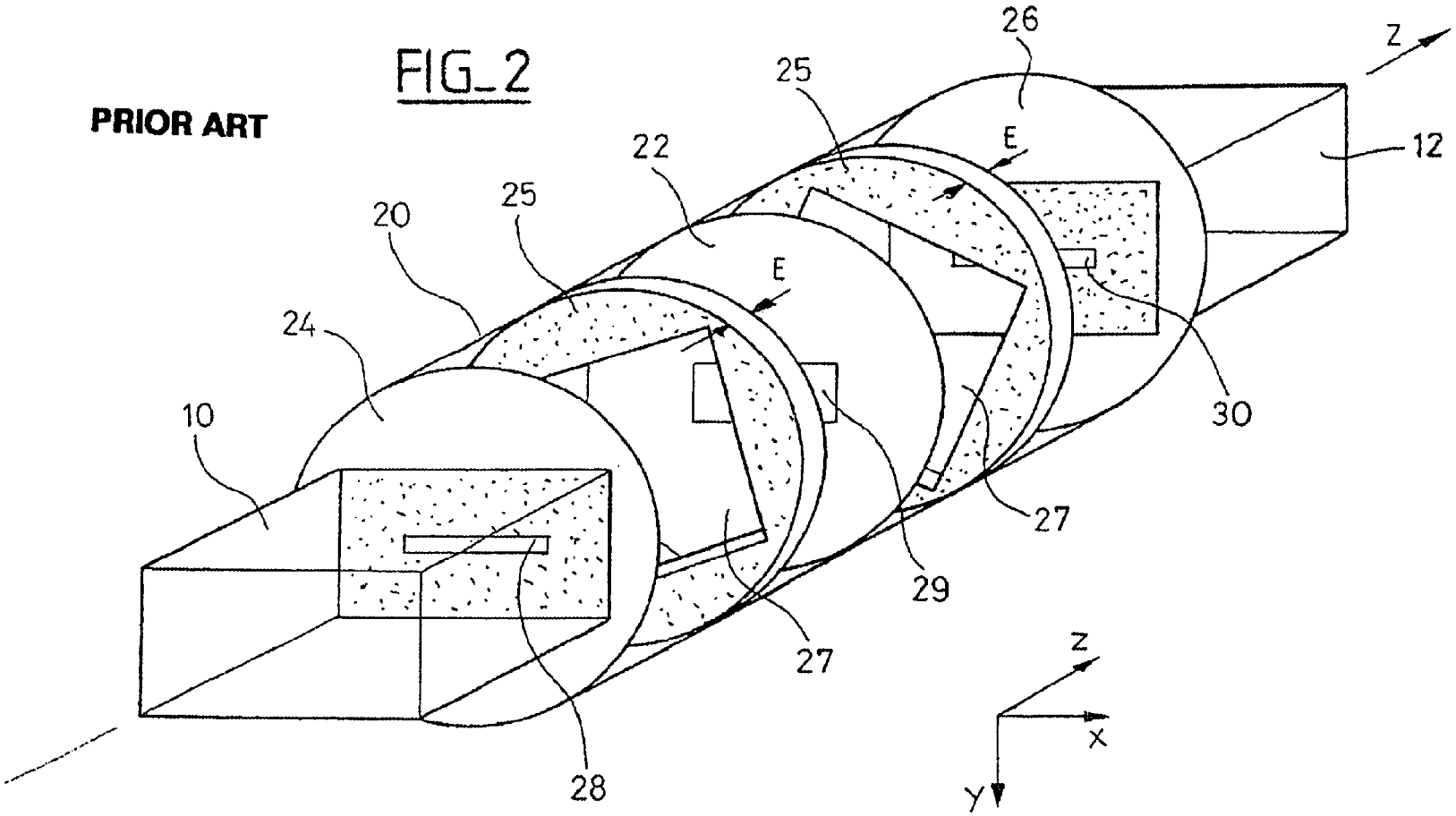
FIG 2 PRIOR ART
FIG. 2 is a diagrammatic perspective view of a prior art multimode circular waveguide microwave filter.
Figure 3:
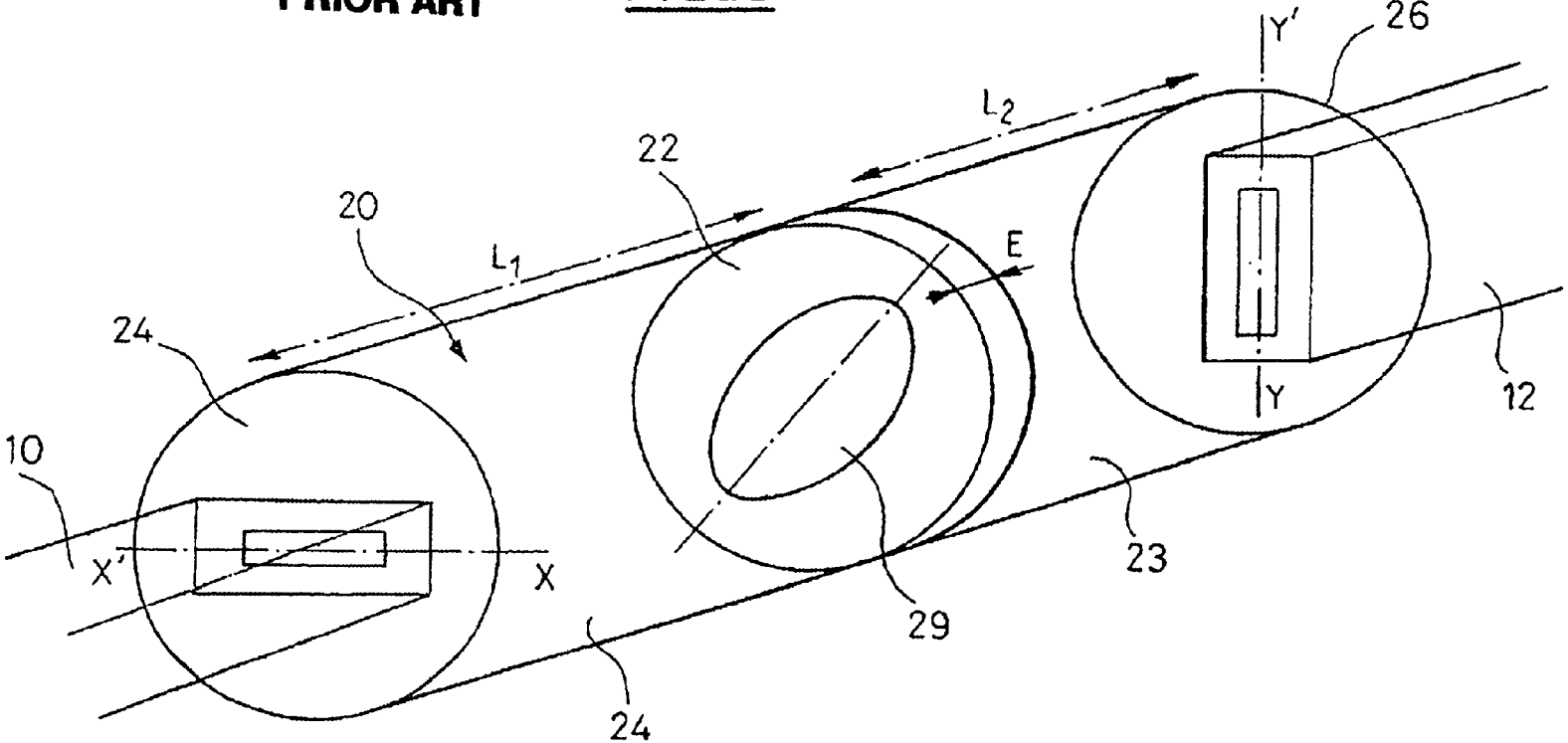
FIG 3 PRIOR ART
FIG. 3 is a diagrammatic perspective view of another prior art multimode circular waveguide microwave filter.
Figure 4:
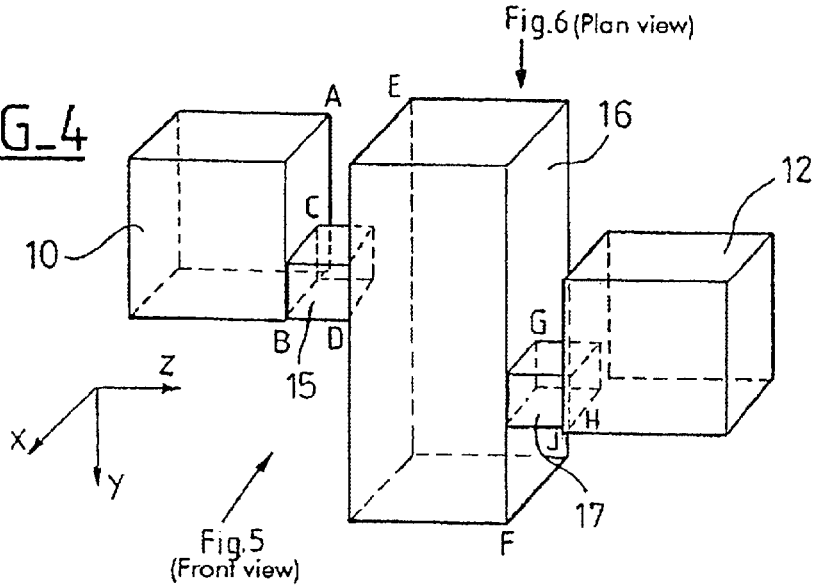
FIG. 4 is a diagrammatic perspective view of one embodiment of a quadruple mode microwave filter of the invention.

FIG. 4 is a diagrammatic perspective view of one embodiment of a quadruple mode microwave filter according to the invention. The filter comprises a rectangular parallelepiped-shaped quadruple mode resonant cavity (16), an input waveguide (10), and an output waveguide (12). In the FIG. 4 embodiment, the single cavity (16) is coupled to the input and output rectangular waveguides (and between them if there are several of them) by rectangular parallelepiped-shaped irises (15, 17). An important feature of the filter according to the invention is that all the faces of the cavities (16) and the irises (15, 17) are either parallel or perpendicular to each other. In the embodiment shown in FIG. 4, the input/output guides are rectangular and all the faces of the cavities (16), the irises (15, 17) and the input/output guides (10, 12) are either parallel or perpendicular to each other.

This feature makes computer simulation of the electromagnetic equations within the structure of the filter particularly easy and reliable, enabling accurate calculation of the necessary dimensions for obtaining the required performance. The reliability of the calculations enables good prediction of the frequencies of the pass-band and the transmission and reflection coefficients of the structure. It remains only to machine the structure from the solid in a material that is a good conductor, for example copper or brass. The geometrical simplicity of the structure also facilitates machining. Because the electromagnetic characteristics of the structure are easily and accurately predicted from simulation calculations, no subsequent adjustment is needed to obtain the required performance.

To summarize, choosing an extremely simple geometry enables simple and reliable simulation and calculation of accurate machining dimensions, and the simple geometry also facilitates machining. All this contributes to producing a filter whose characteristics are predictable to the extent that no adjustment is needed after manufacture.

The input and output guides may of course be circular guides, or even coaxial or other input/outputs, the invention relating not to the geometry of the input and output of the filter, but to the filter itself, as defined in the claims. However, using rectangular guides further simplifies the simulation calculations and has therefore led us to prefer this kind of input/output.

In the embodiment depicted in FIG. 4, the rectangular input guide and the rectangular output guide have the same dimensions. In this embodiment, since any parallelepiped may be completely defined by the coordinates of two opposite points, uppercase letters denote two opposite points on each parallelepiped. These letters are used hereinafter in the description relating to FIGS. 7, 8 and 9.

Figure 5:
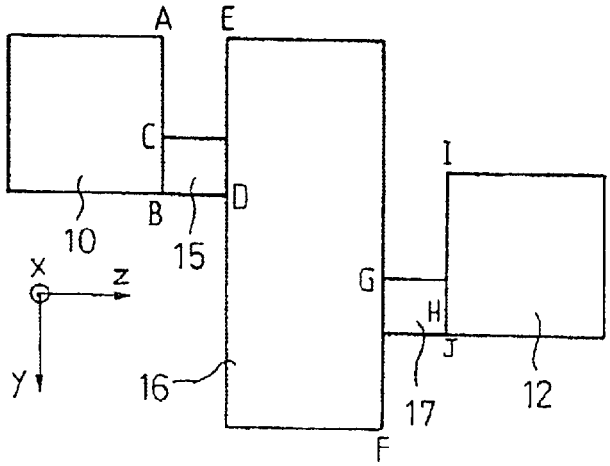
FIG. 5 is a diagrammatic front view of the FIG. 4 embodiment of the filter according to the invention.
Figure 6:
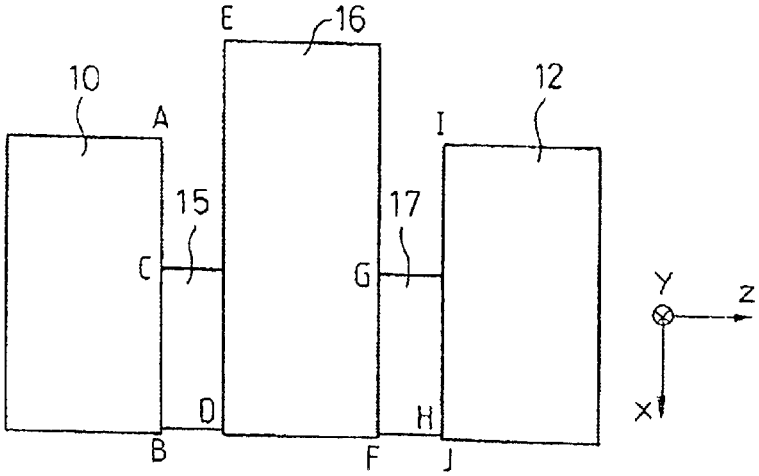
FIG. 6 is a diagrammatic plan view of the FIG. 4 embodiment of the filter according to the invention.

FIGS. 5 and 6 show the same embodiment of a filter according to the invention as FIG. 4, respectively seen from the front and from above. These figures use the same reference numbers as FIG. 4 and represent the same items, and so no further explanation is required.

By way of example, the dimensions of one embodiment of a multiple cavity multimode filter with a plurality of transmission zeros according to the invention may be described with the aid of the points labeled A to J in FIGS. 4, 5 and 6, as follows: the letter A is taken as the origin, and all dimensions in millimeters from this point are expressed in Cartesian coordinates (x, y, z).

For example:

A=(0.00, 0.00, 0.00)
B=(19.05, 9.525, 0.00)
C=(7.59, 6.28, 0.00)
D=(18.21, 9.52, 4.48)
E=(−4.64, −0.06, 4.48)
F=(18.63, 25.25, 13.4)
G=(7.95, 15.63, 13.4)
H=(18.56, 18.61, 17.09)
I=(0.88, 9.32, 17.09)
J=(19.93, 18.845, 17.09)

A prototype of a filter according to the invention has been constructed with the above dimensions, yielding a filter operating in the Ku band around 14 GHz. All dimensions are in millimeters.

To produce a prototype of a filter according to the invention, a block of conductive material, for example brass, is cut into two blocks on a central plane and recesses for the cavities and the irises, and where applicable the input and output guides, are machined into the two blocks, on respective opposite sides of the central plane. The two blocks are then assembled to form a single block with the recesses of the cavities, the irises and, where applicable, the input and output guides, enclosed within it.

FIG. 7 shows transmission measurements obtained from a prototype of a filter according to the invention with the above dimensions. The curve represents the ratio in dB of the electromagnetic energy at the output of the filter to the energy at the input of the filter as a function of the frequency in GHz.

FIG. 8 shows input reflection measurements obtained with a prototype of a filter according to the invention with the above dimensions. The curve represents the ratio in dB of the electromagnetic energy reflected at the input of the filter to the energy impinging on the input of the filter as a function of the frequency in GHz.

As shown in these latter two figures, the bandwidth of this particular brass prototype of the filter according to the invention is greater than 6% and the insertion losses are less than 0.8 dB (not discernible at the scale of the diagram).

FIG. 9 compares simulation and measurement of the reflection coefficient |S11| and the transmission coefficient |S21|. This figure calls for certain remarks. First of all, note that the measurement curves and the simulation curves are generally very similar. This means that the prototype with dimensions obtained from simulation calculations achieves more or less the expected performance.

Secondly, note a slight frequency offset between the first transmission zero on the measured curve |S21| and that on the simulated curve |S21|. This is because of manufacturing tolerances in respect of machining the prototype, which was milled from solid brass. The milling tool having a finite diameter, in a few locations the corners of the rectangular parallelepipeds are rounded. The effect of this is to push up slightly the lowest resonant frequencies.

FIG. 10 is a diagrammatic perspective view of one embodiment of a multi cavity filter comprising at least one quadruple mode microwave cavity according to the invention. The filter comprises (in this order):

an input waveguide 10;

a first iris 15;

a first resonant cavity 16 of rectangular parallelepiped shape;

a second iris 18;

a second resonant cavity 19 of rectangular parallelepiped shape;

a third iris 17; and an output guide 12.

In the embodiment shown, the rectangular input and output guides have the same dimensions. In this embodiment, since any parallelepiped may be completely defined by the coordinates of two opposite points, uppercase letters denote two opposite points on each parallelepiped. These letters are used hereinafter in the description relating to FIG. 13.

FIGS. 11 and 12 show the same embodiment of a filter according to the invention as FIG. 10, respectively seen from above and from the front. These figures use the same reference numbers as FIG. 10 and represent the same items, and so no further explanation is required.

By way of example, the dimensions of one embodiment of a multiple cavity multimode filter with a plurality of transmission zeros according to the invention may be defined with the aid of the points labeled A to N in FIGS. 10, 11 and 12, as follows: the letter A is taken as the origin, and all dimensions in millimeters from this point are expressed in Cartesian coordinates (x, y, z).

For example:

A=(0, 0, 0)
B=(12.95, 6.48, 0)
C=(5.55, 2.96, 0)
D=(12.70, 5.69, 1.67)
E=(−2.50, −0.73, 1.67)
F=(13.11, 16.29, 8.14)
G=(5.90, 10.53, 8.14)
H=(13.05, 11.87, 12.6)
I=(−2.50, −0.69, 12.6)
J=(13.11, 16.31, 19.13)
K=(5.62, 3.14, 19.13)
L=(12.82, 5.58, 21.09)
M=(0.020, 0.21, 21.09)
N=(12.97, 6.69, 21.09)

The above dimensions are smaller than in the embodiment described above with reference to FIGS. 4, 5 and 6, and this yields a higher frequency, around 21 GHz. The above dimensions produce a filter with seven poles and two double (second order) transmission zeros. One of the cavities (16, 19) is therefore a quadruple mode cavity with two zeros and the other cavity is a triple mode cavity with two zeros. As in the FIG. 4 embodiment, all the faces of the cavities 16, 19, the irises 15, 18, 17 and the input and output guides 10, 12 are either parallel or perpendicular to each other.

FIG. 13 shows simulation by calculation of the reflection and transmission coefficients of a multiple cavity filter according to the invention as depicted in FIGS. 10, 11 and 12 with the dimensions referred to above. These simulations show that excellent performance can be obtained with this kind of filter.

The invention has been explained with the aid of a few nonlimiting embodiments. The person skilled in the art will know how to conjugate the various design parameters of the rectangular parallelepiped-shape cavities and irises and the inputs and outputs to obtain an entire range of microwave filters that conform to the principles of the invention and do not depart from the scope of the invention as defined by the following claims.

What is claimed is:

1. Quadruple mode microwave filter having a plurality of transmission zeros, said filter comprising at least one rectangular parallelepiped-shaped quadruple mode resonant cavity (16), an input waveguide (10), and an output waveguide (12), said cavity or cavities being coupled between the input and output waveguides by rectangular parallelepiped-shaped irises (15, 17), all the faces of the cavities (16) and the irises (15, 17) being either parallel or perpendicular to each other, characterized in that there is no tuning or adjustment device.

2. Microwave filter according to claim 1, characterized in that said input waveguide (10) and said output waveguide (12) are rectangular and in that all the faces of the cavities (16), the irises (15, 17) and the input and output waveguides (10, 12) are either parallel or perpendicular to each other.

3. Microwave filter according to claim 1, characterized in that, the resonance frequencies of the modes of electromagnetic propagation being determined by the dimensions of said at least one resonant cavity (16), distribution of electromagnetic energy between the various modes is dependent only on the dimensions and the disposition of said irises (15, 17).

4. Microwave filter according to claim 1, characterized in that the dimensions of said input and output wave guides (10, 12) are chosen to attenuate all electromagnetic modes except for the TE 10 fundamental mode.

5. Microwave filter according to claim 4, characterized in that the dimensions of said input and output waveguides (10, 12) are identical.

6. Microwave filter according to claim 5, characterized in that the input mode and the output mode are the same.

7. Microwave filter according to claim 1, characterized in that the irises (15, 17) are offcentered along the two transverse axes (X, Y) of said filter.

8. Microwave filter according to claim 1, characterized in that coupling between the various resonant modes of said at least one resonant cavity and with the input and output modes is obtained exclusively by means of the irises (15, 17), to the exclusion of any screw or other tuning or adjustment mechanism.

* * * * *